US011619388B2

(12) United States Patent
Prociw et al.

(10) Patent No.: US 11,619,388 B2
(45) Date of Patent: Apr. 4, 2023

(54) DUAL FUEL GAS TURBINE ENGINE PILOT NOZZLES

(71) Applicant: Delavan Inc., West Des Moines, IA (US)

(72) Inventors: Lev Alexander Prociw, Johnston, IA (US); Jason A. Ryon, Carlisle, IA (US); Jacob Greenfield, Granger, IA (US)

(73) Assignee: Collins Engine Nozzles, Inc., Des Moines, IA (US)

( * ) Notice: Subject to any disclaimer, the term of this patent is extended or adjusted under 35 U.S.C. 154(b) by 392 days.

(21) Appl. No.: 15/850,175

(22) Filed: Dec. 21, 2017

(65) Prior Publication Data

US 2019/0195498 A1 Jun. 27, 2019

(51) Int. Cl.

| | |
|---|---|
| ***F23R 3/34*** | (2006.01) |
| ***F23R 3/36*** | (2006.01) |
| ***F23R 3/14*** | (2006.01) |
| ***F23R 3/16*** | (2006.01) |
| ***F23R 3/10*** | (2006.01) |

(52) U.S. Cl.
CPC ..... *F23R 3/343* (2013.01); *F23R 3/14* (2013.01); *F23R 3/36* (2013.01); *F23R 3/10* (2013.01); *F23R 3/16* (2013.01)

(58) Field of Classification Search
CPC .... F23R 3/14; F23R 3/343; F23R 3/36; F23R 3/10
See application file for complete search history.

(56) References Cited

U.S. PATENT DOCUMENTS

| | | | | |
|---|---|---|---|---|
| 8,464,537 | B2 | 6/2013 | Khan et al. | |
| 8,850,820 | B2 | 10/2014 | Milosavljevic et al. | |
| 9,239,167 | B2 * | 1/2016 | Williams | F23R 3/343 |
| 9,488,371 | B2 * | 11/2016 | Shi | C10J 3/503 |
| 9,939,157 | B2 * | 4/2018 | Patel | F23R 3/286 |
| 2001/0004827 | A1 * | 6/2001 | Vandervort | F23R 3/14 60/39.55 |

(Continued)

FOREIGN PATENT DOCUMENTS

| | | |
|---|---|---|
| EP | 2458284 A2 | 5/2012 |
| WO | 2015/069354 A2 | 5/2015 |

(Continued)

OTHER PUBLICATIONS

Extended European Search Report dated Jan. 30, 2019, issued during the prosecution of European Patent Application No. EP 18213213.4 (9 pages).

*Primary Examiner* — Todd E Manahan
*Assistant Examiner* — David P. Olynick
(74) *Attorney, Agent, or Firm* — Locke Lord LLP; Scott D. Wofsy; Joshua L. Jones

(57) ABSTRACT

A pilot nozzle for a dual fuel turbine engine includes an inner air circuit, a gaseous fuel circuit radially outward from the inner air circuit, a liquid fuel circuit radially outward from the inner air circuit, an outer air circuit radially outward from the liquid fuel circuit and the gaseous fuel circuit, and a shroud radially outward from the outer air circuit. The shroud is configured to stabilize a pilot recirculation zone downstream from outlets of the inner and outer air circuits and the liquid and gaseous fuel circuits.

16 Claims, 4 Drawing Sheets

(56) References Cited

U.S. PATENT DOCUMENTS

| | | | | |
|---|---|---|---|---|
| 2009/0165436 | A1* | 7/2009 | Herbon | F23R 3/286 60/39.826 |
| 2012/0260664 | A1 | 10/2012 | Harding | |
| 2014/0338337 | A1* | 11/2014 | Prociw | F23R 3/28 60/737 |
| 2014/0338342 | A1* | 11/2014 | Graham | F02C 7/22 60/740 |
| 2016/0258630 | A1 | 9/2016 | Mitchell et al. | |
| 2016/0265778 | A1 | 9/2016 | Patel et al. | |
| 2016/0305327 | A1* | 10/2016 | Patel | F23R 3/286 |
| 2016/0313006 | A1 | 10/2016 | Stewart | |
| 2017/0350598 | A1* | 12/2017 | Boardman | F23R 3/14 |
| 2021/0381436 | A1* | 12/2021 | Matsuyama | F23R 3/343 |

FOREIGN PATENT DOCUMENTS

| | | | |
|---|---|---|---|
| WO | 2015/076883 | A2 | 5/2015 |
| WO | 2017/002076 | A1 | 1/2017 |

* cited by examiner

DUAL FUEL GAS TURBINE ENGINE PILOT NOZZLES

BACKGROUND OF THE INVENTION

1. Field of the Invention

The present disclosure relates to combustors, and more particularly to pilot nozzles such as those used in combustor nozzles for gas turbine engines.

2. Description of Related Art

In gas turbine engines, such as industrial gas turbine engines used for power production, there is often a need to utilize more than one type of fuel. Dual fuel injectors within the gas turbine engines operate to mix air and fuel together for combustion. A dual fuel system can introduce additional challenges with respect to mixing fuel and air. To reduce NOx emissions, air and fuel typically need to be adequately mixed. Fuel staging can be used to achieve better mixing and low NOx combustion.

The conventional techniques have been considered satisfactory for their intended purpose. However, there is an ever present need for improved fuel injection and air-fuel mixing. This disclosure provides a solution for this.

SUMMARY OF THE INVENTION

A pilot nozzle for a dual fuel turbine engine includes an inner air circuit, a gaseous fuel circuit radially outward from the inner air circuit, a liquid fuel circuit radially outward from the inner air circuit, an outer air circuit radially outward from the liquid fuel circuit and the gaseous fuel circuit, and a shroud radially outward from the outer air circuit. The shroud is configured to stabilize a pilot re-circulation zone downstream from outlets of the inner and outer air circuits and the liquid and gaseous fuel circuits.

In certain embodiments, the shroud defines a longitudinal axis and includes an upstream end at a first axial position proximate to the outer air circuit and a downstream end at a second axial position downstream from the outlets of the inner and outer air circuits and the liquid and gaseous fuel circuits. The downstream end of the shroud can include a diverging portion.

In accordance with some embodiments, the pilot re-circulation zone is radially inward from an inner diameter of the shroud. The liquid fuel circuit can be radially outward from the gaseous fuel circuit. The outer air circuit can be a converging, non-swirling air circuit. The inner air circuit can be a swirling air circuit. The inner and outer air circuits and the liquid and gaseous fuel circuits can be co-axial with one another. The pilot nozzle can include an ignition device radially inward from the inner air circuit. The pilot nozzle can include a floating seal positioned between the ignition device and the inner air circuit.

In accordance with another aspect, pilot nozzle for a dual fuel turbine engine includes a gaseous fuel circuit radially outward from the inner air circuit, a liquid fuel circuit radially outward from the inner air circuit, an outer air circuit radially outward from the liquid fuel circuit and the gaseous fuel circuit, and an ignition device radially inward from the inner air circuit.

In accordance with another aspect, a combustor system includes a main nozzle and a pilot nozzle, as described above, mounted to the main nozzle. The combustor system includes main nozzle air circuit positioned radially outward from the shroud of the pilot nozzle. A main nozzle fuel injector is positioned radially outward from the shroud of the pilot nozzle downstream from the main nozzle air circuit. The shroud is configured to re-direct air flow exiting from the main nozzle air circuit.

In accordance with some embodiments, the main nozzle air circuit includes a plurality of air slots configured to provide cooling air to the shroud of the pilot nozzle and to provide mixing air to the main nozzle fuel injector. The shroud can define a longitudinal axis and can include an upstream end with a first axial position proximate to an upstream wall of the main nozzle and a downstream end with a second axial position proximate to an outlet of the main nozzle fuel injector. The main nozzle fuel injector can be a dual fuel injector that can include a gaseous fuel circuit and a liquid fuel circuit.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
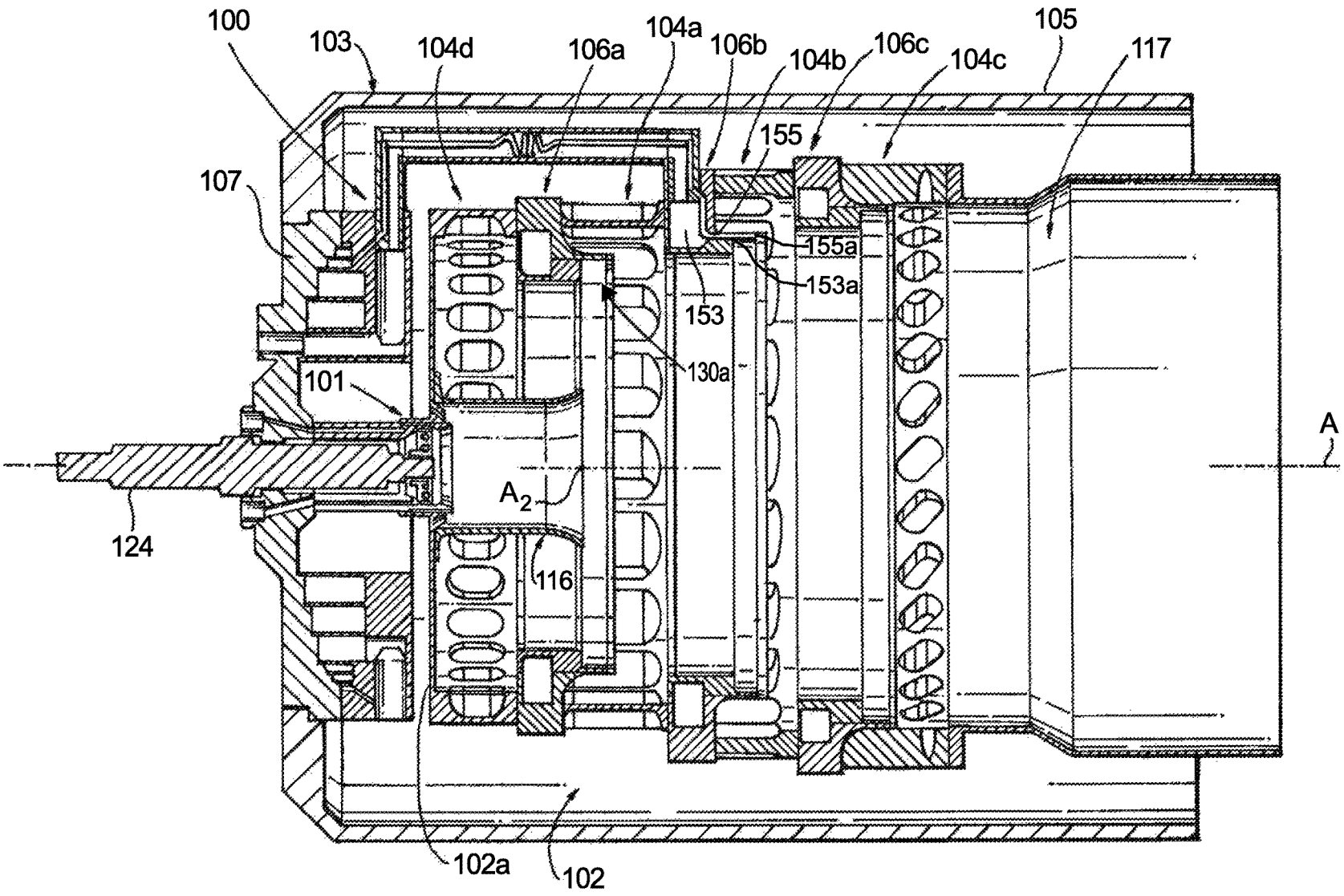
FIG. 1 is a schematic cross-sectional side view of an exemplary embodiment of a combustor system with a pilot nozzle constructed in accordance with embodiments of the present disclosure, showing the shroud downstream from the pilot nozzle.

Reference will now be made to the drawings wherein like reference numerals identify similar structural features or aspects of the subject disclosure. For purposes of explanation and illustration, and not limitation, a partial view of an exemplary embodiment of a combustor system with an exemplary embodiment of an air mixer in accordance with the disclosure is shown in FIG. 1 and is designated generally by reference character 100. Other embodiments of combustor systems in accordance with the disclosure, or aspects thereof, are provided in FIGS. 2A-3, as will be described. The systems and methods described herein can be used to distribute air and mix it with fluids, including gas or liquid fuel, such as in multiple stage, dual fuel injection for gas turbine engines.

In dual fuel injectors that utilize fuel staging to mix air and fuel together to achieve lower NOx, typically the majority of the air is injected at the largest diameter near the wall. Conventional ignition is difficult due to the quantity of air and the lack of fuel near the wall. As such, a pilot nozzle near the center line is required to ignite a small quantity of fuel in a quiescent zone. As shown in FIG. 1, a dual fuel turbine engine 103 includes an engine case 105 and a combustor system 100 positioned radially inward from the engine case 105. The combustor system 100 includes a main nozzle 102 and an air-blast pilot nozzle 101 operatively connected to the main nozzle 102. A dual fuel manifold 107 is upstream from main nozzle 102 and is operatively connected to engine case 105. Fuel to feed pilot nozzle 101 is metered from the internal dual fuel manifold 107. In other words, pilot nozzle 101 is a dual fuel pilot and can utilize gas and/or liquid fuel. Main nozzle 102 is similarly a dual fuel nozzle and its respective stages are fed from internal dual fuel manifold 107.

With continued reference to FIG. 1, main nozzle 102 includes main nozzle fuel injectors 106*a*-106*c* positioned radially outward and downstream from pilot nozzle 101. Main nozzle fuel injectors 106*a*, 106*b* and 106*c* are primary, secondary and tertiary stage fuel injectors, respectively. Main nozzle 102 includes main nozzle air circuits 104*a*-104*d* positioned alternating between main nozzle fuel injectors 106*a*-106*c* to impart swirl to air going into the ignition area of main nozzle 102. Main nozzle air circuits 104*d* and 104*a* are primary stage air circuits, and main nozzle air circuits 104*b* and 104*c* are secondary and tertiary stage air circuits, respectively. The swirling air helps to atomize the fuel entering into the ignition area of main nozzle 102 from fuel injectors 106*a*-106*c* and mixes with the fuel to create a fuel-air mixture. Fuel injectors 106-106*c* each include respective liquid and gaseous fuel circuits, e.g. they are dual-fuel fuel injectors. Gas and liquid fuel circuits, 153 and 155, respectively, are schematically shown for secondary main nozzle fuel injector 106*b*. Each fuel circuit 153 and 155 is in fluid communication with the dual fuel manifold 107 and each has a respective outlet 153*a* and 155*a*. Those skilled in the art will readily appreciate that main nozzle fuel injectors 106*a* and 106*c* include similar gas and liquid fuel circuits with similar outlets to accommodate dual fuel. Those skilled in the art will readily appreciate that a downstream combustor 117 is fed by main nozzle air circuits 104*a*-104*d* and main nozzle fuel injectors 106*a*-106*c*.

With continued reference to FIG. 1, fuel injectors 106*a*-106*c* and air circuits 104*a*-104*d* form main nozzle 102. Main nozzle air circuits 104*a*-104*d* and main nozzle fuel injectors 106*a*-106*c* are positioned radially outward from a shroud 116 of pilot nozzle 101. Main nozzle fuel injectors 106*a*-106*c* are positioned downstream from their respective main nozzle air circuits 104*a*-104*d*. Pairs of fuel injectors 106*a*-106*d* and air circuits 104*a*-104*d* together form three stages of main nozzle 102. Main nozzle air circuits 104*a*-104*d* and main nozzle fuel injectors 106*a*-106*c* act as one staged dual-fuel nozzle 102 with multiple injection stages (primary, secondary and tertiary). Main nozzle fuel injector 106*a* and main nozzle air circuits 104*a* and 104*d* form the primary injection stage of main nozzle 102, main nozzle fuel injector 106*b* and main nozzle air circuit 104*b* form the secondary injection stage of main nozzle 102, and main nozzle fuel injector 106*c* and main nozzle air circuit 104*c* form the tertiary injection stage of main nozzle 102.

Figure 2A:
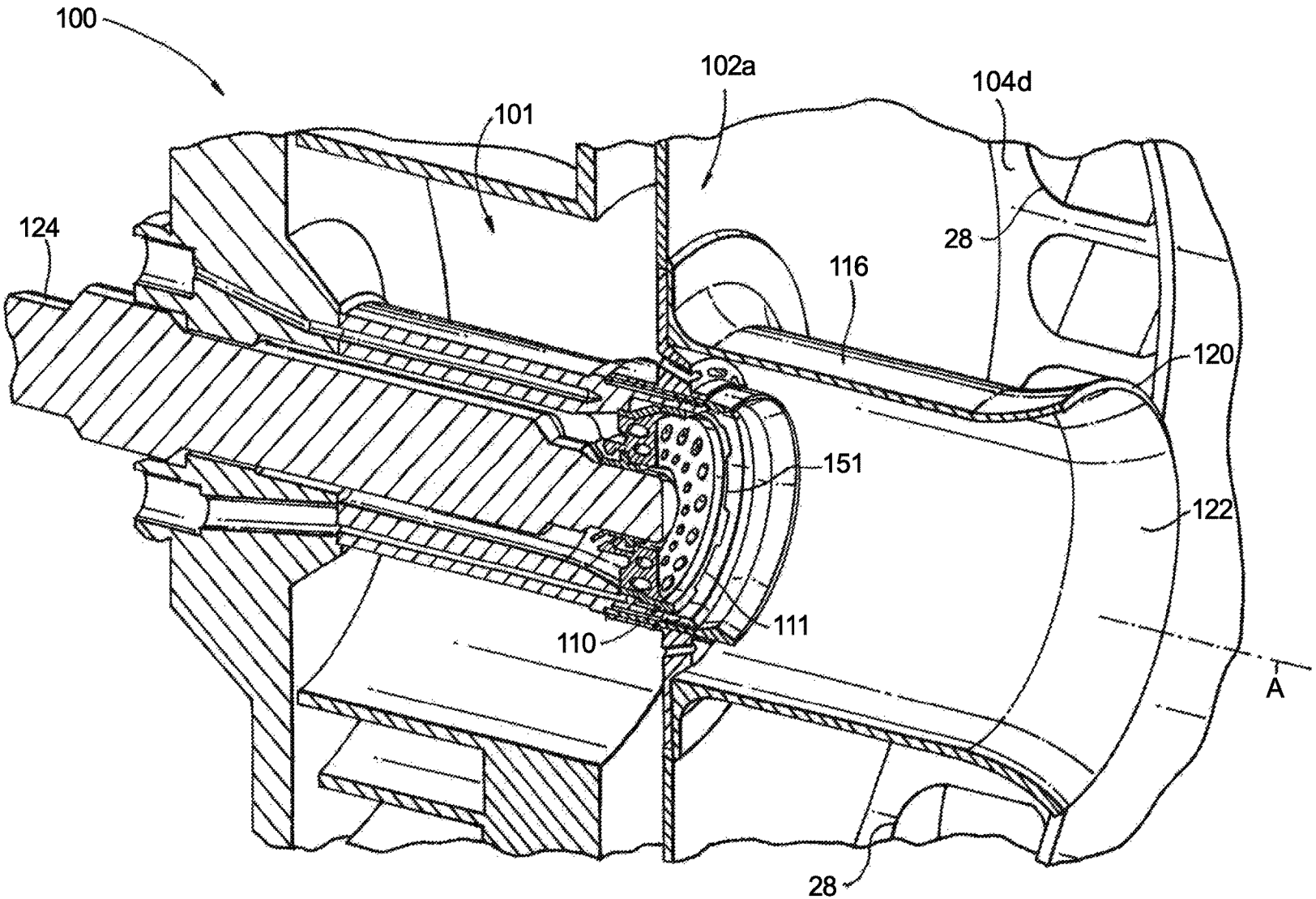
FIG. 2A is a schematic perspective view of a portion of the combustor system of FIG. 1, showing the shroud between a pilot re-circulation zone the main nozzle primary air circuit.
Figure 2B:
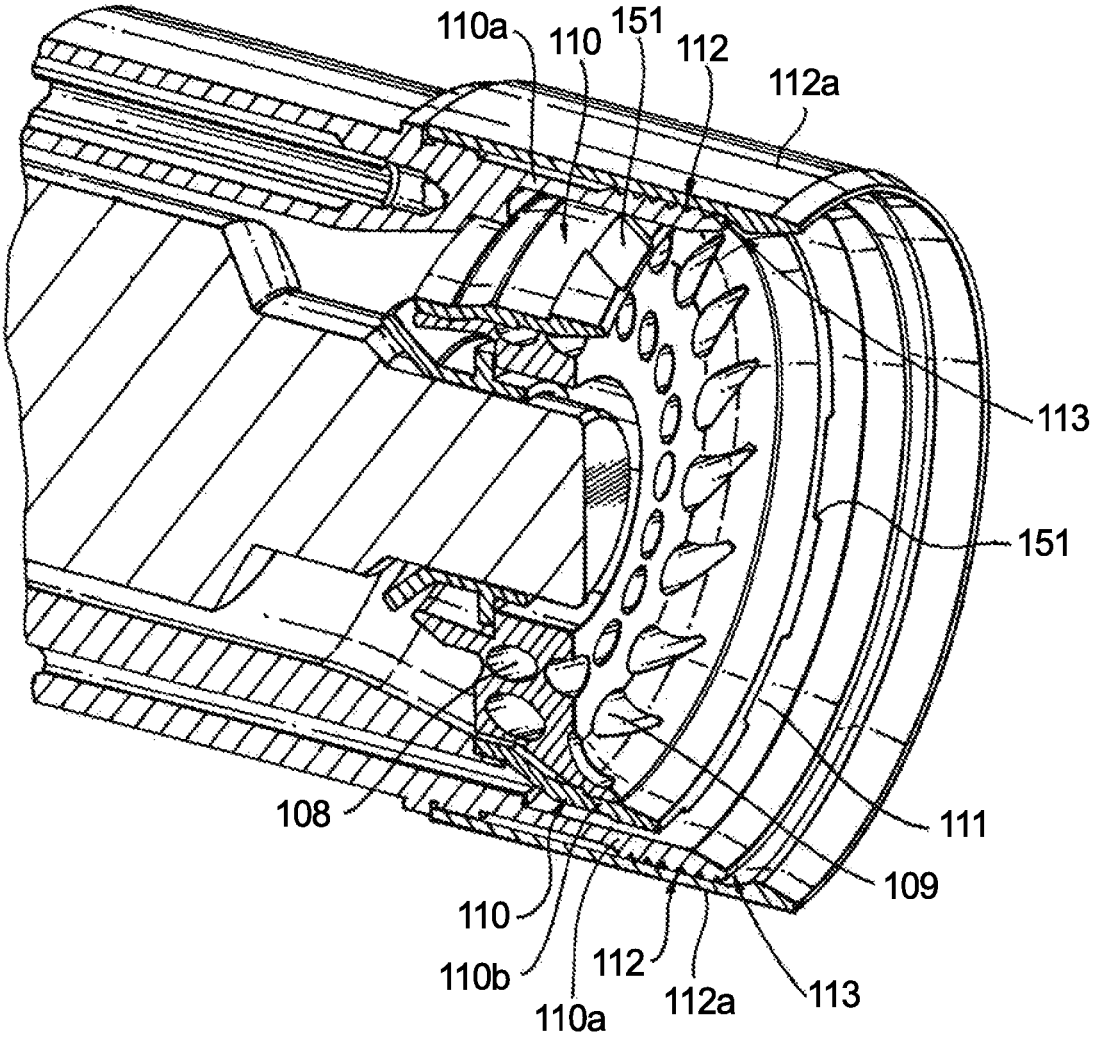
FIG. 2B is an enlarged schematic perspective view of a portion of the combustor system of FIG. 1, showing the gaseous fuel circuit and its plurality of circumferentially spaced apart slots.
Figure 3:
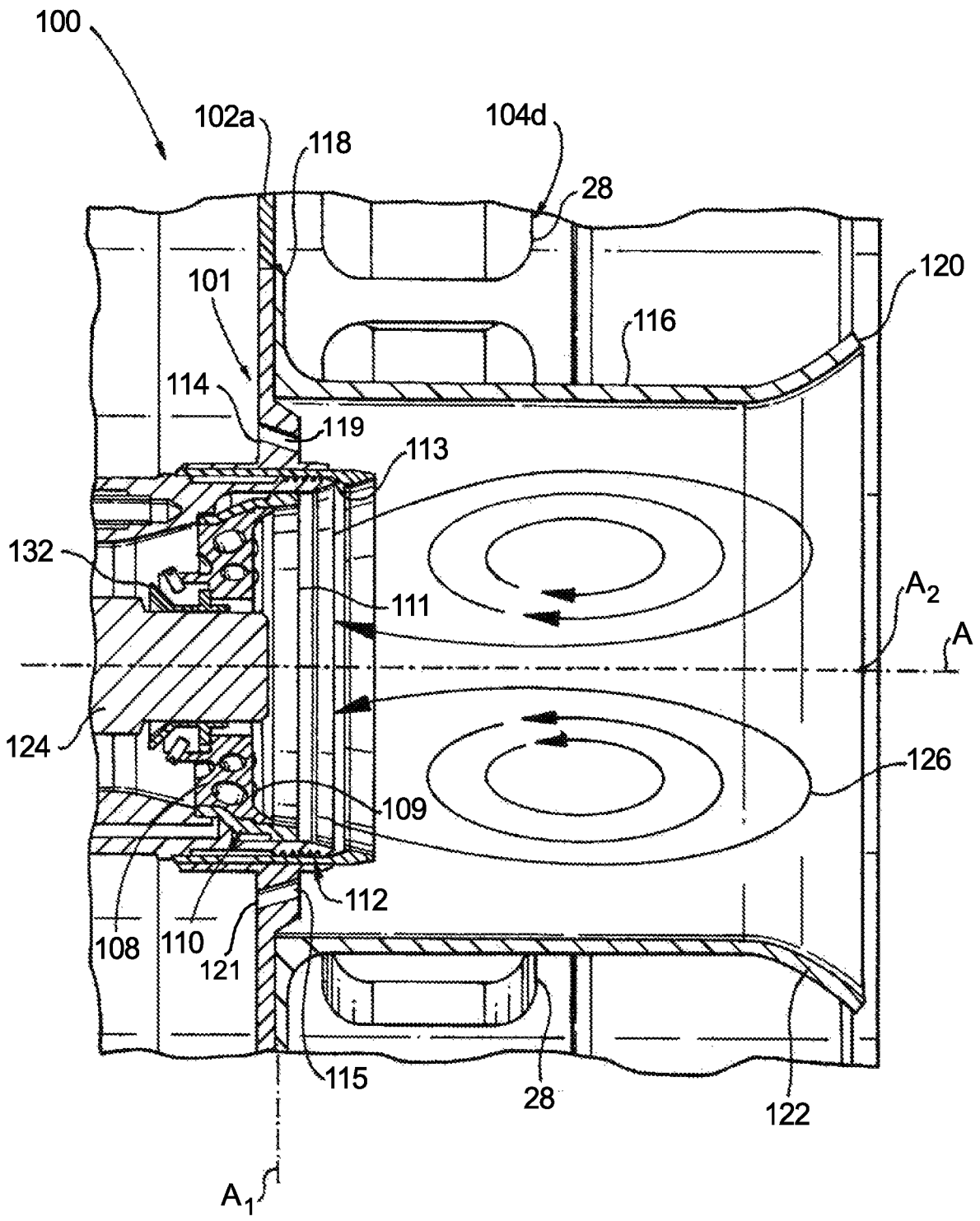
FIG. 3 is an enlarged schematic cross-sectional axial view of a portion of the combustor system of FIG. 1, schematically showing the pilot re-circulation zone isolated from the main nozzle primary air circuit.

As shown in FIGS. 2A-3, pilot nozzle 101 for a dual fuel turbine engine 103 includes a swirling inner air circuit 108. Swirling inner air circuit 108 is a discrete jet core swirler. Discrete jet core air swirler 108 is more compact and less expensive than a conventional bladed swirler. Discrete jet core air swirler 108 includes an upstream inlet side proximate to a floating seal 132 (described below) and a downstream outlet side with air outlets 109. A gaseous fuel circuit 110 is radially outward from the inner air circuit 108. Gaseous fuel circuit 110 is formed by two annular bodies 110*a* and 110*b* and includes an upstream inlet in fluid communication with the gas fuel flow path of the dual fuel manifold 107 and an outlet 111 downstream from the inlet. Outlet 111 is in fluid communication with an area radially inward from an inner diameter of shroud 116. Outlet 111 includes a plurality of circumferentially spaced apart slots 151 formed in annular body 110*b* of the gaseous fuel circuit 110. Pilot nozzle 101 includes an ignition device 124 radially inward from inner air circuit 108. It is contemplated that ignition device 124 can be an intermittent plasma arc, continuous plasma, or torch flame from an upstream source along center line, e.g. longitudinal axis A. Pilot nozzle 101 includes a floating seal 132 positioned between ignition device 124 and inner air circuit 108. Floating seal 132 is a floating air seal which allows for insertion of ignition device 124 from the exterior of engine 103. Floating seal 132 accommodates differences in thermal expansion properties between the mating components.

With continued reference to FIGS. 2A-3, a liquid fuel circuit 112 is radially outward from the inner air circuit 108 and an outer air circuit 114 is radially outward from liquid fuel circuit 112 and the gaseous fuel circuit 110. Liquid fuel circuit 112 is formed by an outer annular body 112*a* and an inner annular body, e.g. annular body 110*a* of the gaseous fuel circuit 110. Liquid fuel circuit 112 includes an upstream inlet in fluid communication with a liquid fuel flow path of the dual fuel manifold 107 and a downstream outlet 113. Outer air circuit 114 is a converging, non-swirling air circuit and is formed by an annular body having a converging flow path 119. Outer air circuit 114 has an upstream inlet 121 and a downstream outlet 115. The inner and outer air circuits, 108 and 114, respectively, and the liquid and gaseous fuel circuits, 112 and 110, respectively, are co-axial with one another. Pilot nozzle 101 is able to ignite a very small quantity of fuel (cool ignition) which then goes on to ignite much greater quantities of fuel in the downstream stages (associated with fuel injectors 106*a*-106*c*). Pilot nozzle 101 is also able to maintain a relatively small recirculation zone that stabilizes the larger flames as compared with traditional nozzles that include larger recirculation zones that produce more NOx.

As shown in FIGS. 2A and 3, shroud 116 is radially outward from outer air circuit 114. Shroud 116 is configured to stabilize a pilot re-circulation zone 126 downstream from outlets of the inner and outer air circuits and the liquid and gaseous fuel circuits, 109, 115, 113 and 111, respectively, by at least partially isolating pilot re-circulation zone 126 from primary stage air circuit 104*d*. This isolation acts to form a quiescent zone within the inner diameter of shroud 116 separate from the main nozzle stages (primary, secondary, tertiary) of main nozzle 102. Pilot re-circulation zone 126 is schematically shown by the arrows formed in oval-like shapes in FIG. 3. Pilot re-circulation zone 126 is radially inward from an inner diameter of shroud 116. Pilot re-circulation zone 126 is in an area also known as a pilot cavity that holds a local pilot flame used to ignite one or more stages of main nozzle 102, e.g. a primary stage main nozzle flame. The primary stage main nozzle flame (generated through primary air circuits 104*a* and 104*d*, and primary fuel injector 106*a*) ignites and stabilizes the secondary main power flames formed by secondary nozzle air circuit 104*b* and secondary nozzle fuel injector 106*b*, and third main power flames formed by tertiary nozzle air circuit 104*c* and tertiary nozzle fuel injector 106*c*.

With continued reference to FIGS. 2A and 3, shroud 116 defines a longitudinal axis A and includes an upstream end 118 at a first axial position $A_1$ proximate to outer air circuit 114 and an upstream wall 102*a* of main nozzle 102. Shroud 116 includes a downstream end 120 at a second axial position $A_2$ downstream from the outlets of the inner and outer air circuits and the liquid and gaseous fuel circuits, 109, 115, 113 and 111, respectively. Axial position $A_2$ is proximate to an axial position of an outlet 130*a* of primary fuel injector 106*a*. Those skilled in the art will readily appreciate that the outlet 130*a* of primary fuel injector 106*a* can include a gas fuel outlet and/or a liquid fuel outlet, similar to outlets 153*a* and 155*a*, and that numeral 130*a* in FIG. 1 points generally to both. Shroud 116, and its position with respect to outlet 130*a*, is configured to re-direct airflow exiting from outlets 28 of primary air circuit 104*d*. Downstream end 120 of shroud 116 includes a diverging portion 122. Diverging portion 122 is used to shape the air flow pattern for the main nozzle, e.g. for the primary air circuit 104*d* and primary fuel injector 106*a*, and to encourage the re-circulation zone 126 of pilot nozzle 101. Primary air circuit 104*d* includes a plurality of air slots (outlets 28) that provide cooling air to shroud 116 of pilot nozzle 101 and provide mixing air to one or more of the main nozzle fuel injectors 106*a-c*. The other air circuits 106*b*-106*c* have similar air slot outlets to outlets 28. Diverging portion 122 can shape the air flow direction of air from outlets 28 radially outward toward the primary stage of main nozzle 102, e.g. toward primary air circuit 104*a* and primary fuel injector 106*a*, or towards the latter stages, to optimize the mixing performance of the radially outward main nozzle 102.

It is contemplated that combustor systems as described herein can be retrofitted into existing gas turbine engines. The methods and systems of the present disclosure, as described above and shown in the drawings, provide for combustor systems with superior properties including a more stable pilot flame resulting in more efficient light-off, better fuel-air mixing, resulting in more efficient burning and reduced emissions. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A pilot nozzle for a dual fuel turbine engine comprising:

an inner air circuit;

a gaseous fuel circuit radially outward from the inner air circuit;

a liquid fuel circuit radially outward from the inner air circuit; an outer air circuit radially outward from the liquid fuel circuit and the gaseous fuel circuit;

a shroud radially outward from the outer air circuit configured to stabilize a pilot re-circulation zone downstream from outlets of the inner and outer air circuits and the liquid and gaseous fuel circuits, wherein the shroud includes an upstream end with a first axial position proximate to an upstream wall of a pilot nozzle end, a non-converging non-diverging section defining a longitudinal axis downstream of the upstream wall of the pilot nozzle end, and a downstream end of the shroud including a diverging portion; and an ignition device radially inward from the inner air circuit, wherein the inner air circuit includes an outlet that is axially upstream relative to an inlet of the outer air circuit, wherein the ignition device is at least partially located upstream of the inner air circuit outlet, and wherein the ignition device is located entirely upstream of each of the outlets of each of the fuel circuits;

wherein the inner air circuit includes an inner air circuit wall with discrete jet bores defined therethrough from inlets on an upstream surface of the inner air circuit wall to outlets on a downstream surface of the inner air circuit wall, wherein the outer air circuit includes an outer air circuit wall with discrete jet bores defined therethrough from inlets on an upstream surface of the outer air circuit wall to outlets on a downstream surface of the outer air circuit wall, wherein the downstream surface of the inner air swirler wall is axially upstream relative to the upstream surface of the outer air circuit wall.

2. The pilot nozzle as recited in claim 1, wherein the pilot re-circulation zone is radially inward from an inner diameter of the shroud.

3. The pilot nozzle as recited in claim 1, wherein the liquid fuel circuit is radially outward from the gaseous fuel circuit.

4. The pilot nozzle as recited in claim 1, wherein the outer air circuit is a converging, non-swirling air circuit.

5. The pilot nozzle as recited in claim 1, wherein the inner air circuit is a swirling air circuit.

6. The pilot nozzle as recited in claim 1, wherein the shroud, the inner and outer air circuits and the liquid and gaseous fuel circuits are co-axial with one another.

7. The pilot nozzle as recited in claim 1, further comprising a floating seal positioned between the ignition device and the inner air circuit.

8. The pilot nozzle as recited in claim 1, wherein each of the inner air circuits, the gaseous fuel circuit, the liquid fuel circuit include an independent outlet into the pilot re-circulation zone, and wherein the outlets of each of the fuel circuits are downstream of at least a portion of the shroud.

9. The pilot nozzle as recited in claim 1, wherein only the downstream end of the shroud diverges.

10. The pilot nozzle as recited in claim 1, wherein only the downstream end of the shroud diverges.

11. A pilot nozzle for a dual fuel turbine engine comprising:

an inner air circuit;

a gaseous fuel circuit radially outward from the inner air circuit;

a liquid fuel circuit radially outward from the inner air circuit;

an outer air circuit radially outward from the liquid fuel circuit and the gaseous fuel circuit; and, an ignition device radially inward from the inner air circuit, wherein the inner air circuit includes an outlet that is axially upstream relative to an inlet of the outer air circuit, wherein the ignition device is at least partially located upstream of the inner air circuit outlet, and wherein the ignition device is located entirely upstream of each of the outlets of each of the fuel circuits;

wherein the inner air circuit includes an inner air circuit wall with discrete jet bores defined therethrough from inlets on an upstream surface of the inner air circuit wall to outlets on a downstream surface of the inner air circuit wall, wherein the outer air circuit includes an outer air circuit wall with discrete jet bores defined therethrough from inlets on an upstream surface of the outer air circuit wall to outlets on a downstream surface of the outer air circuit wall, wherein the downstream surface of the inner air circuit wall is axially upstream relative to the upstream surface of the outer air circuit wall.

12. A combustor system comprising:

a main nozzle;

a pilot nozzle for a dual fuel turbine engine mounted to the main nozzle, wherein the pilot nozzle comprises:

an inner air circuit;

a gaseous fuel circuit radially outward from the inner air circuit;

a liquid fuel circuit radially outward from the inner air circuit; an outer air circuit radially outward from the liquid fuel circuit and the gaseous fuel circuit;

an ignition device radially inward from the inner air circuit, wherein the inner air circuit includes an outlet that is axially upstream relative to an inlet of the outer air circuit, wherein the ignition device is at least partially located upstream of the inner air circuit outlet, and wherein the ignition device is located entirely upstream of each of the outlets of each of the fuel circuits;

a shroud radially outward from the outer air circuit configured to stabilize a pilot re-circulation zone downstream from the inner and outer air circuits and the liquid and gaseous fuel circuits, wherein the shroud includes an upstream end with a first axial position proximate to an upstream wall of a main nozzle end, a non-converging non-diverging section defining a longitudinal axis downstream of the upstream wall of the main nozzle end, and a downstream end of the shroud including a diverging portion, wherein the inner air circuit includes an inner air circuit wall with discrete jet bores defined therethrough from inlets on an upstream surface of the inner air circuit wall to outlets on a downstream surface of the inner air circuit wall, wherein the outer air circuit includes an outer air circuit wall with discrete jet bores defined therethrough from inlets on an upstream surface of the outer air circuit wall to outlets on a downstream surface of the outer air circuit wall, wherein the downstream surface of the inner air circuit wall is axially upstream relative to the upstream surface of the outer air circuit wall;

a main nozzle air circuit positioned radially outward from the shroud of the pilot nozzle; and a main nozzle fuel injector positioned radially outward from the shroud of the pilot nozzle downstream from the main nozzle air circuit, wherein the shroud is configured to re-direct air flow exiting from the main nozzle air circuit.

13. The combustor system as recited in claim 12, wherein the main nozzle air circuit includes a plurality of air slots configured to provide cooling air to the shroud of the pilot nozzle and to provide mixing air to the main nozzle fuel injector.

14. The combustor system as recited in claim 12, wherein the pilot re-circulation zone is radially inward from an inner diameter of the shroud.

15. The combustor system as recited in claim 12, wherein the main nozzle fuel injector is a dual fuel injector that includes a gaseous fuel circuit and a liquid fuel circuit.

16. A pilot nozzle for a dual fuel turbine engine comprising:

an inner air circuit;

a gaseous fuel circuit radially outward from the inner air circuit;

a liquid fuel circuit radially outward from the inner air circuit;

an outer air circuit radially outward from the liquid fuel circuit and the gaseous fuel circuit;

a shroud radially outward from the outer air circuit configured to stabilize a pilot re-circulation zone downstream from outlets of the inner and outer air circuits and the liquid and gaseous fuel circuits, wherein the shroud includes an upstream end with a first axial position proximate to an upstream wall of a pilot nozzle end, a non-converging non-diverging section defining a longitudinal axis downstream of the upstream wall of the pilot nozzle end, and a downstream end of the shroud including a diverging portion; and an ignition device radially inward from the inner air circuit, wherein the inner air circuit includes an outlet that is axially upstream relative to an inlet of the outer air circuit, wherein the ignition device is at least partially located upstream of the inner air circuit outlet, and wherein the ignition device is located entirely upstream of each of the outlets of each of the fuel circuits.

* * * * *